US005720343A

United States Patent [19]

Kilgore et al.

[11] Patent Number: 5,720,343

[45] Date of Patent: Feb. 24, 1998

[54] HIGH TEMPERATURE, HIGH PRESSURE RETRIEVABLE PACKER

[75] Inventors: Marion D. Kilgore, Dallas; John C. Gano, Carrollton, both of Tex.

[73] Assignee: Halliburton Company, Dallas, Tex.

[21] Appl. No.: 780,150

[22] Filed: Jan. 3, 1997

Related U.S. Application Data

[62] Division of Ser. No. 611,867, Mar. 6, 1996.

[51] Int. Cl.[6] ..... E21B 33/129

[52] U.S. Cl. ..... 166/120; 166/134

[58] Field of Search ..... 166/119, 120, 166/123, 134, 182

[56] References Cited

U.S. PATENT DOCUMENTS

| | | | |
|---|---|---|---|
| 4,512,399 | 4/1985 | Gano et al. | 166/120 |
| 4,516,634 | 5/1985 | Pitts | 166/120 |
| 4,582,134 | 4/1986 | Gano et al. | 166/120 |
| 4,664,188 | 5/1987 | Zunkel et al. | 166/134 |
| 4,669,539 | 6/1987 | Barrington | 166/120 |
| 4,754,814 | 7/1988 | Jordan, Jr. | 166/134 X |
| 5,433,269 | 7/1995 | Hendrickson | 166/134 |
| 5,492,173 | 2/1996 | Kilgore et al. | 166/66.4 |

OTHER PUBLICATIONS

"Qualification of an HP/HT Retrievable Production Packer" SPE 28895, Bob Fennell, Elf Aquitaine Production, Bernard Avignon, Elf Petroland, and W.D. Henderson, Baker Oil Tools; pp. 295–301; Oct. 25, 1994.

*Primary Examiner*—George A. Suchfield

*Attorney, Agent, or Firm*—William M. Imwalle; Paul I. Herman

[57] ABSTRACT

In a retrievable packer adapted for service under high temperature and high pressure operating conditions, the packer is purpose-designed as a cut-to-release packer. That is, this retrievable packer has no built-in release mechanism. An internal cinch slip is used to retain the packer in its set position and thereby prevent the accidental release of the packer. The only way it can be released is by severing the mandrel. The cut point is opportunely designed so that the mandrel is severed in a precise location such that not only is the packer released, but all the packer and tail pipe are then retrievable as a unit. The primary advantage of a cut-to-release packer is that it can withstand extreme tubing loads occurring during production and stimulation.

3 Claims, 9 Drawing Sheets

HIGH TEMPERATURE, HIGH PRESSURE RETRIEVABLE PACKER

This is a divisional application of application Ser. No. 08/611,867 filed on Mar. 6, 1996.

BACKGROUND OF THE INVENTION

In the course of treating and preparing subterranean wells for production, a well packer is run into the well on a work string or a production tubing. The purpose of the packer is to support production tubing and other completion equipment, such as a screen adjacent to a producing formation, and to seal the annulus between the outside of the production tubing and the inside of the well casing to block movement of fluids through the annulus past the packer location. The packer is provided with anchor slips having opposed camming surfaces which cooperate with complementary opposed wedging surfaces, whereby the anchor slips are radially extendible into gripping engagement against the well casing bore in response to relative axial movement of the wedging surfaces.

The packer also carries annular seal elements which are expandable radially into sealing engagement against the bore of the well casing in response to axial compression forces. Longitudinal movement of the packer components which set the anchor slips and the sealing elements may be produced either hydraulically or mechanically.

After the packer has been set and sealed against the well casing bore, it should maintain sealing engagement upon removal of the hydraulic or mechanical setting force. Moreover, it is essential that the packer remain locked in its set and sealed configuration while withstanding hydraulic pressures applied externally or internally from the formation and/or manipulation of the tubing string and service tools without unsetting the packer or interrupting the seal. This is made more difficult in deep wells in which the packer and its components are subjected to high downhole temperatures, for example, as high as 600 degrees F., and high downhole pressures, for example, 5,000 pounds per square inch ("psi"). Moreover, the packer should be able to withstand variation of externally applied hydraulic pressures at levels up to as much as 15,000 psi in both directions, and still be retrievable after exposure for long periods, for example, from 10 to 15 years or more. After such long periods of extended service under extreme pressure and temperature conditions, it is desirable that the packer be retrievable from the well, with the anchor slips and seal elements being retracted sufficiently to avoid seizure against well bore restrictions that are smaller than the retracted seal assembly, for example, at a makeup union, collar union, nipple or the like.

Currently, permanent packers are used for long-term placement in wells requiring the packer to withstand pressures as high as 15,000 psi at 600° F. Conventional permanent packers are designed in such a way that they become permanently fixed to the casing wall and that helps in the sealing of the element package. However, permanent packers must be milled for removal. One of the major problems involved in removing a permanent packer is that its element package normally has large metal backup rings or shoes that bridge the gap between the packer and the casing and provide a support structure for the seal element to keep it from extruding out into the annulus. The problem with that arrangement is that the large metal backup shoes act like a set of slips and will not release from the casing wall.

Present retrievable high pressure packers use multiple C-ring backup shoes that are difficult to retract when attempting to retrieve the packer. A further limitation on the use of high pressure retrievable packers of conventional design, for example, single slip packers, is that if there is any slack in setting of the packer, or any subsequent movement of the packer, some of the compression force on the element package is relieved. This reduces the total compression force exerted on the seal elements between the mandrel and the casing, therefore permitting a leakage passage to develop across the seal package.

Further, it is common knowledge in designing currently used retrievable high pressure packers that a longer slip can be used to more evenly distribute the load into the casing. However, what generally occurs is that a slip will reach a length with a corresponding length of slip tooth contact, such that it becomes difficult or impossible to achieve initial slip tooth penetration into the casing wall when setting the packer. There becomes so much tooth length in contact with the casing that the setting slip load is insufficient to anchor the packer.

Another problem in high temperaure, high pressure packers of any type involves the slips damaging the casing. With the axial loads and pressure differential loads at the design limits, the total axial force on the packer slip is almost 500,000 pounds. Discounting friction, this load is multiplied to a radial force into the casing wall when divided by the tangent of the slip/wedge contact angle. Since the packer may be set inside uncemented casing, potential casing damage is a major concern.

With conventional segmented slips, the inherent three- or four-point loading of the casing wall will deform the casing into a predisposed slip pattern, and the fully loaded unsupported casing will deform into roughly a triangle or a square, etc., corresponding to the number of individual slips used. Nodes will appear on the casing outer diameter corresponding to each slip segment. This result is not desirable, as it will then become very difficult to land and properly set another packer after the first one is removed. Further, as the tubing in such wells is typcially made of an expensive corrosion resistant alloy, scratches and indentations are to be avoided, as they can act as stress risers or corrosion points.

Therefore, what is needed is a packer capable of safely deploying at its design limits in totally unsupported casing, without damaging the casing.

Another problem with high pressure retrievable packers is that they cannot withstand high tubing loads during production and stimulation operations.

Another problem with high pressure retrievable packers is that no matter how well designed, they can sometimes accidentally release.

Therefore, it is an object of the invention to provide a retrievable packer that can operate efficiently at pressure differentials of 15,000 psi and temperatures to 600° F. without releasing.

It is further an object of this invention to provide a retrievable packer that has a slip design that allows longer slips to be effectively used.

It is further an object of this invention to provide a tighter element seal and a more dependable sealing system.

It is further an object of this invention to provide a retrievable packer that cannot be accidentally released.

SUMMARY OF THE INVENTION

The foregoing objects are achieved according to the present invention by a well packer having a barrel slip that is progressive set, which further includes a cinch slip to prevent accidental release. The barrel slip has cones that are generally complementary to cones on wedges that set the barrel slip, wherein the wedge cones are spaced so as to be progressively further distances apart from their complementary slip cones. Ordinarily, the mating wedges which deploy the slip would be machined in a like manner with matching diameters and distances between cones. However, in the inventive device, the gaps between the wedge cones and slip cones are progressively larger, as viewed from the center of the longitudinal center of the slip to its outer edges, wherein the section of slip where the angle of the wedges reverse is referred to as the center of the slip. Thereby, the cones of the wedges which mate with the centermost cones of the slip make contact first by design. This forces the center of the slip to be loaded first. The remaining wedge cones have not yet made contact with their complementary slip cones. As greater forces are exerted on the wedges from end to end, the wedge will deform slightly and the next cone of the wedge will make contact with its matching portion of slip. Continuing in a likewise manner, as the wedges are loaded higher and higher, more wedge cones come into bearing contact with the slip. The standoff between the cones of the wedges is controlled very precisely such that slight elastic yielding takes place by deforming the wedge inwardly.

This design effectively allows initial setting of the packer with very little slip tooth contact area. This permits the slip to quickly get a good grip into the casing wall. Subsequent higher loading brings more and more slip teeth to bear and prevents overstressing the casing. This design may also be used with a plurality of individual slips in place of the barrel slip.

Further, the use of a barrel slip provides full circumferential contact with the casing. This design effectively spreads the slip-to-casing load over a large area and minimizes slip-to-casing contact stresses. With the barrel slip, the casing is always urged into a circular cross section, even at full loads. Furthermore, the slip is designed to load uniformly such that equal loads are borne by all the slip teeth. This ensures minimum slip tooth penetration into the casing wall.

In another aspect of the invention, an internal cinch slip is used to retain the packer in its set position. The cinch slip is designed similarly to the barrel slip, and is flexible enough to easily ratchet over the mating bottom sub connector threads. It is spring loaded with simple wave springs, and eliminates "backlash" usually associated with a one piece heavy-duty cinch slip. Elimination of backlash creates a tighter element seal and provides a more dependable sealing system. The cinch slip serves to keep the packer in its set position and thereby prevent the accidental release of the packer.

In yet another aspect of the invention, the packer is purpose-designed as a cut-to-release packer. That is, this retrievable packer has no built-in release mechanism, but instead has a locking assembly that locks the packer in its deployed position. The only way it can be released is by severing the mandrel. In a preferred embodiment, a no-go shoulder is provided in the mandrel on which to positively locate a wireline chemical cutter. The cut point is thereby opportunely designed so that the mandrel is severed in a precise location such that not only is the packer released, but all the packer and tail pipe are then retrieved as a unit. No part of the packer is left in the well for subsequent fishing operations, nor is any milling required, as would be with a traditional permanent packer.

The primary advantage of a cut-to-release packer is that it can withstand extreme tubing loads occurring during production and stimulation. It also positively prevents accidental release of the packer.

The novel features of the invention are set forth with particularity in the claims. The invention will best be understood from the following description when read in conjunction with the accompanying drawings.

DESCRIPTION OF THE PREFERRED EMBODIMENT

Figure 1:
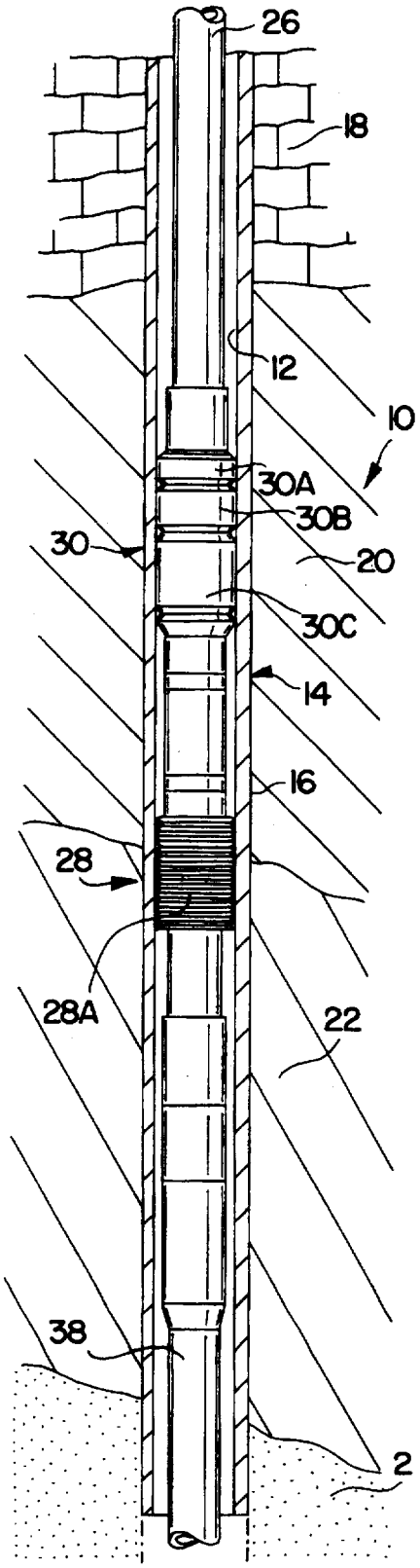
FIG. 1 is a longitudinal view in elevation and section of a retrievable well packer embodying the features of the present invention set in the casing of a well bore providing a releasable seal with the casing wall and a tubing string extending to the packer.

In the description which follows, like parts are marked throughout the specification and drawings with the same reference numerals, respectively. The drawings are not necessarily to scale and the proportions of certain parts have been exaggerated to better illustrate details and features of the invention. In the following description, the terms "upper," "upward," "lower," "below," "downhole" and the like, as used herein, shall mean in relation to the bottom, or furthest extent of, the surrounding wellbore even though the wellbore or portions of it may be deviated or horizontal. Where components of relatively well known design are employed, their structure and operation will not be described in detail.

Referring now to FIG. 1, a well packer 10 is shown in releasably set, sealed engagement against the bore 12 of a well casing 14. The tubular well casing 14 lines a well bore 16 which has been drilled through an oil and gas producing formation, intersecting multiple layers of overburden 18, 20 and 22, and then intersecting a hydrocarbon producing formation 2. The mandrel 34 of the packer 10 is connected to a tubing string 26 leading to a wellhead for conducting produced fluids from the hydrocarbon bearing formation 2 to the surface. The lower end of the casing which intersects the producing formation is perforated to allow well fluids such as oil and gas to flow from the hydrocarbon bearing formation 2 through the casing 14 into the well bore 12.

The packer 10 is releasably set and locked against the casing 14 by an anchor slip assembly 28. A seal element assembly 30 mounted on the mandrel 34 is expanded against the well casing 14 for providing a fluid tight seal between the mandrel and the well casing so that formation pressure is held in the well bore below the seal assembly and formation fluids are forced into the bore of the packer to flow to the surface through the production tubing string 26.

Figure 2A:
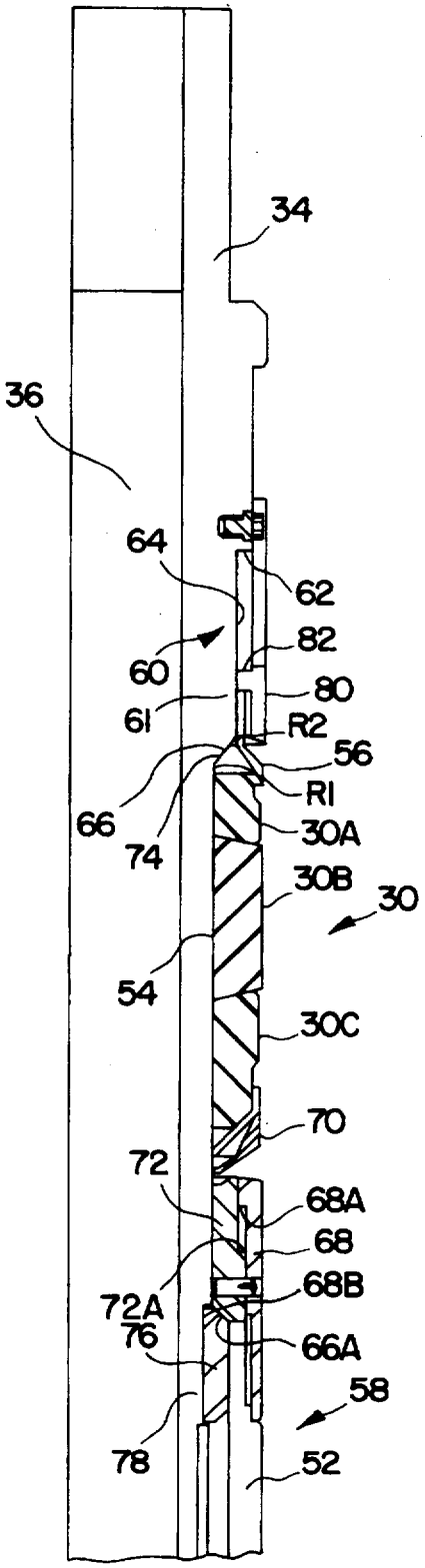
FIGS. 2A–2C, inclusive and taken together, form a longitudinal view in section of the retrievable well packer and seal assembly of the invention showing the seal assembly relaxed and the packer slips retracted as the packer is run into a well bore.
Figure 2B:
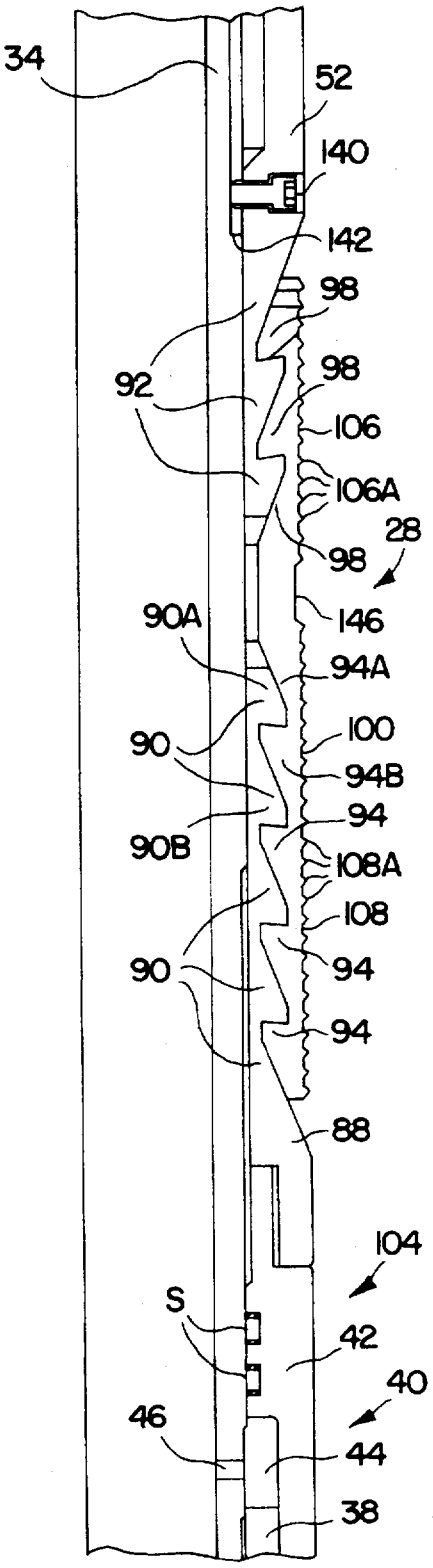
Figure 2C:
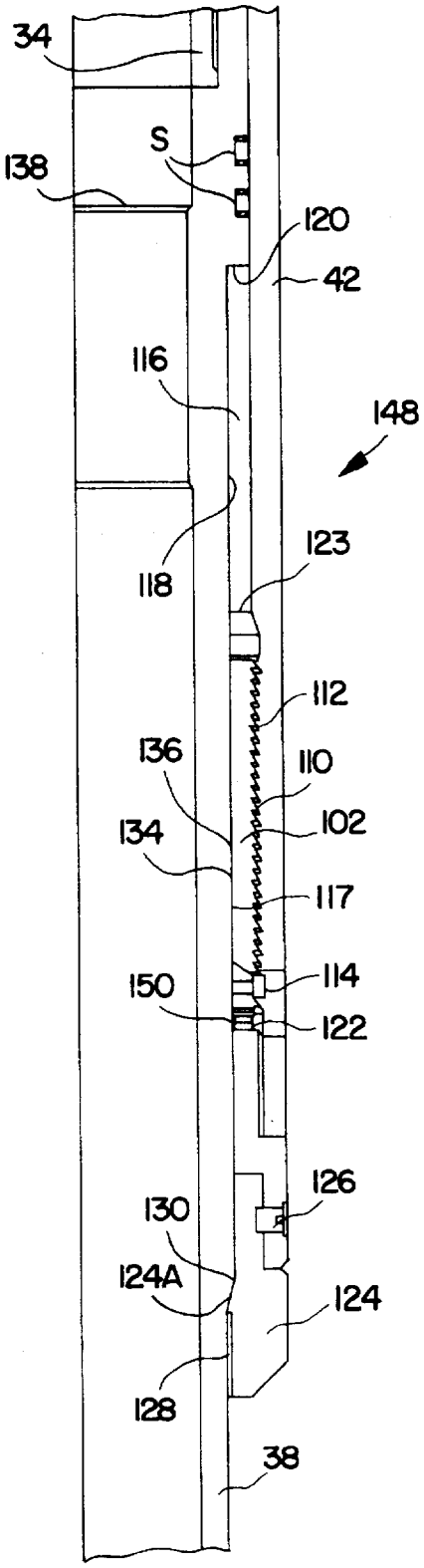

Referring now to FIGS. 2A–2C, which shows the packer as it is configured for running into the well for placement, the packer 10 is run into the well bore and set by hydraulic means. The anchor slip 100 of the anchor slip assembly 28 are first set against the well casing 14, followed by expansion of the seal element assembly 30. The packer 10 includes force transmitting apparati 104 and 58 with a cinch slip 102 which maintains the set condition after the hydraulic setting pressure is removed. The packer 10 is readily retrieved from the well bore by cutting the mandrel 34 and by a straight upward pull which is conducted through the mandrel and thereby permits the anchor slip 100 to retract and the seal elements 30A to relax, thus freeing the packer for retrieval to the surface. The entire packer and attached tubing is retrieved together.

The anchor slip assembly 28 and the seal element assembly 30 are mounted on a tubular body mandrel 34 having a cylindrical bore 36 defining a longitudinal production flow passage. The lower end of the mandrel 34 is firmly coupled to a bottom connector sub 38. The bottom connector sub 38 is continued below the packer within the well casing for connecting to a sand screen, polished nipple, tail screen and sump packer, for example. The central passage of the packer bore 36 as well as the polished bore, bottom sub bore, polished nipple, sand screen and the like are concentric with and form a continuation of the tubular bore of the upper tubing string 26.

In the preferred embodiment described herein, the packer 10 is set by a hydraulic actuator assembly 40, which comprises a piston 42 concentrically mounted on the mandrel 34, enclosing an annular chamber 44 which is open to the cylindrical bore 36 at port 46. The hydraulic actuator assembly 40 is coupled to the lower force transmitting assembly 104 for radially extending the anchor slip assembly 28 and seal element assembly 30 into set engagement against the well bore. Referring to FIG. 2B, the hydraulic actuator includes a tubular piston 42 which carries annular seals S for sealing engagement against the external surface of the mandrel 34. The piston 42 is also slidably sealed against the external surface of a bottom connector sub 38. The piston 42 is firmly attached to a lower wedge 88. Hydraulic pressure is applied through the inlet port 46 which pressurizes the annular chamber 44. As the chamber is pressurized, the piston 42 is driven upward, which thereby also moves the lower wedge upward.

Figure 8:
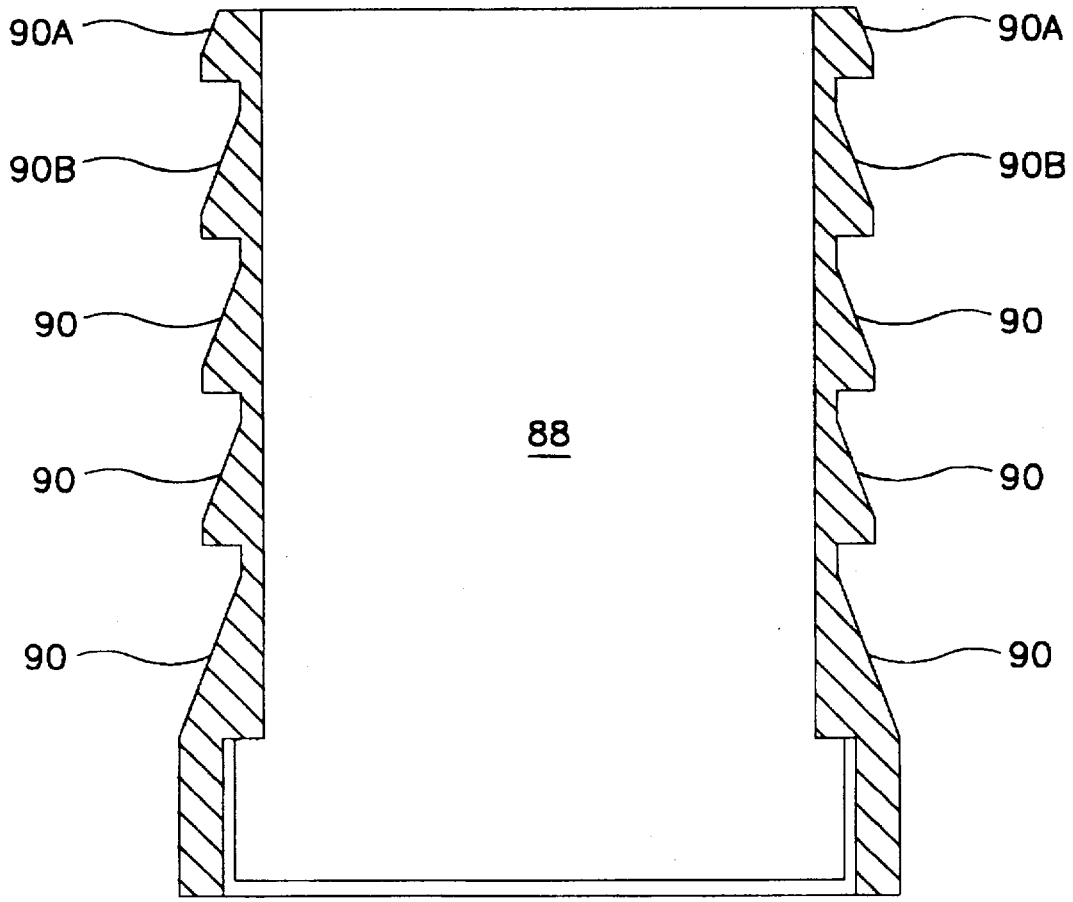

Referring now to FIG. 8, the lower wedge 88 is positioned between the external surface of the mandrel 34 and the lower bore of the barrel slip 100 and features a number of upwardly facing frustoconical wedging surface cones 90. In the run in position, the lower wedge 88 and its cones 90 are fully retracted, and are blocked against further downward movement relative to the slip carder by the piston 42. The upper wedge 52 likewise has a number of downwardly facing frustoconical wedging surface cones 92.

The slip anchor assembly 28 includes a barrel slip 100 snugly fitted on the exterior surface of the upper and lower wedges 52 and 88. Referring now to FIGS. 5–8, the barrel slip 100 has a plurality of slip anchors 28A which are mounted for radial movement. A large number of slips, such as twelve or fourteen, is preferable. Each of the anchor slips includes lower gripping surfaces 106 and lower gripping surfaces 108 positioned to extend radially into the casing wall. Each of the gripping surfaces has horizontally oriented gripping edges (106A, 108A) which provide gripping contact in each direction of longitudinal movement of the packer 10. The gripping surfaces, including the horizontal gripping edges, are radially curved to conform with the cylindrical internal surface of the well casing bore against which the slip anchor members are engaged in the set position. As the packer is generally required to potentially withstand more loading in the upward direction, the barrel slip 100 has a longer lower face to resist upward movement. For purposes of this application, the "center" of the slip is the point along the axial length of the packer at which the gripping edges change directions, at 146.

The interior of the barrel slip 100 comprises a series of frustoconical surface cones 94, 98. The lower slip cones 94 are positioned adjacent to and generally complementary with the lower wedge cones 90, while the upper slip cones 98 are positioned adjacent to and generally complementary with the upper wedge cones 92. The number of lower slip cones 94 is higher than the number of upper slip cones 98, to complement the longer lower gripping surface 106 of the barrel slip. In this embodiment, the lower slip cones 94 are spaced equidistantly from each other. The upper slip cones 98 are also spaced equidistantly from each other.

Use of a barrel slip as shown here allows full circumferential contact with the casing. This design effectively spreads the slip-to-casing load over a large area and minimizes slip-to-casing contact stresses. With the use of a barrel slip, the casing is always urged into a circular cross section, even at full loads. Furthermore, the slip is designed to load uniformly such that equal loads are borne by all the slip teeth. This ensures minimum slip toth penetration into the casing wall.

The lower wedge cones 90 are not spaced identically to the corresponding lower slip cones 94. Instead, the two uppermost lower wedge cones 90A, 90B are spaced just slightly farther apart than their corresponding slip cones 94A, 94B. Thereafter, moving downward, each wedge cone is spaced progressively farther apart. While this embodiment is shown with four lower wedge cones, any number of cones would be acceptable. The upper wedge 52 is designed similarly to the lower wedge, in that the gap between the upper wedge cones 92 is slightly larger than the gap between the corresponding slip cones 98. This embodiment is shown with two cones, but the inventive concept would work with any number of cones, as long as the cones are spaced progressively further apart, with the smallest gap being between the lowest two upper wedge cones.

One of the inventive concepts disclosed in this application is the use of progressive loading of the slip. That is, the slip is loaded against the casing well near the longitudinal center of the slip first, then as load on the slip increases, the rest of the slip is progressively loaded against the casing wall from the longitudinal center out to the outer edge. The preferred embodiment described herein uses a constant gap between cones on the slip, and progressively broader gaps on the wedges. However, as is readily apparent, there are any number of combinations of gapping in the slip cones and wedge cones that can achieve the desired result. For example, the gaps between the wedge cones could be uniform, and the gaps between the slip cones could be progressively smaller from the center to the upper and lower edges. Any combination of slip cones and wedge cones that would result in the wedge cones being slightly progressively farther longitudinally removed from their corresponding slip cones, as viewed from the center to the upper and lower edges of the slip, would achieve the desired result. While this preferred embodiment is shown using a barrel slip, the other inventive concepts of this application could be used with other types of slips.

The slip carrier is releasably coupled to the lower wedge 88 by anti-preset shear screws. According to this arrangement, as the piston 42 is extended in response to pressurization through the port 46, the lower wedge 88, anchor slip assembly 28, and upper force transmitting assembly 58 are extended upwardly toward the seal element assembly 30. The upper force transmitting assembly comprises an element retainer collar 68 which is coupled to the upper wedge 52.

The seal element assembly 30 is mounted directly onto an external support surface 54 of the mandrel 34. The seal element assembly 30 includes an upper outside packing end element 30A, a center packing element 30B and a lower outside packing end element 30C. The upper end seal element 30A is releasably fixed against axial upward movement by engagement against an upper backup shoe 56, which in turn is connected to a cover sleeve 80. The upper backup shoe 56 and cover sleeve 80 are movably mounted on the mandrel 34 for longitudinal movement from a lower position, as shown in FIG. 2A, to an upper position (FIG. 3A) which permits the seal element assembly to travel upwardly along the external surface of the mandrel 34. In this arrangement, the seal element assembly undergoes longitudinal compression by the upper force transmitting assembly 58 until a predetermined mount of compression and expansion have been achieved.

Sealing engagement is provided by prop apparatus 60 which is mounted on the mandrel 34. In the preferred embodiment, the prop apparatus is a radially stepped shoulder member 61 which is integrally formed with the mandrel, with the prop surface 64 being radially offset with respect to the seal element support surface 54. In this arrangement, the prop apparatus 60 forms a part of the mandrel 34. The seal element prop surface 64 is preferably substantially cylindrical, and the seal element support surface 54 is also preferably substantially cylindrical. As can be seen in FIG. 2A, the seal element prop surface 64 is substantially concentric with the seal element support surface 54.

The ramp member 66 has an external surface 74 which slopes transversely with respect to the seal element support surface 54 and the seal element prop surface 64. Preferably, the slope angle as measured from the seal element support surface 54 to the external surface 74 of the ramp member 66 is in the range of from about 135 degrees to about 165 degrees. The purpose of the ramp surface is to provide a gradual transition to prevent damage to the upper seal element 30A as it is deflected onto the radially offset prop surface 64.

Referring to FIG. 2A, a transitional radius R1 is provided between the mandrel surface 54 and the sloping ramp surface 74, and a second radius R2 is provided between the ramp surface 74 and the radially offset prop surface 64. The two radius surfaces R1, R2 complement each other so that there is a smooth movement of the upper end element seal 30A from the mandrel surface 54 to the radially offset prop surface 64 without damage to the seal element material. For a slope angle A of 135 degrees, a relatively small radius of transition R1 of 0.06 inch radius is provided, and the second, relatively large radius is approximately 0.5 inch radius. According to this arrangement, a gently sloping ramp surface 74 provides an easy transition for the preloaded upper end seal element 30A to be deflected onto the radially offset prop surface 64. As the slope angle is increased, it becomes more important to radius the corners of the transition, and the specific radius values are determined based primarily on the size of the packer.

Figure 3A:
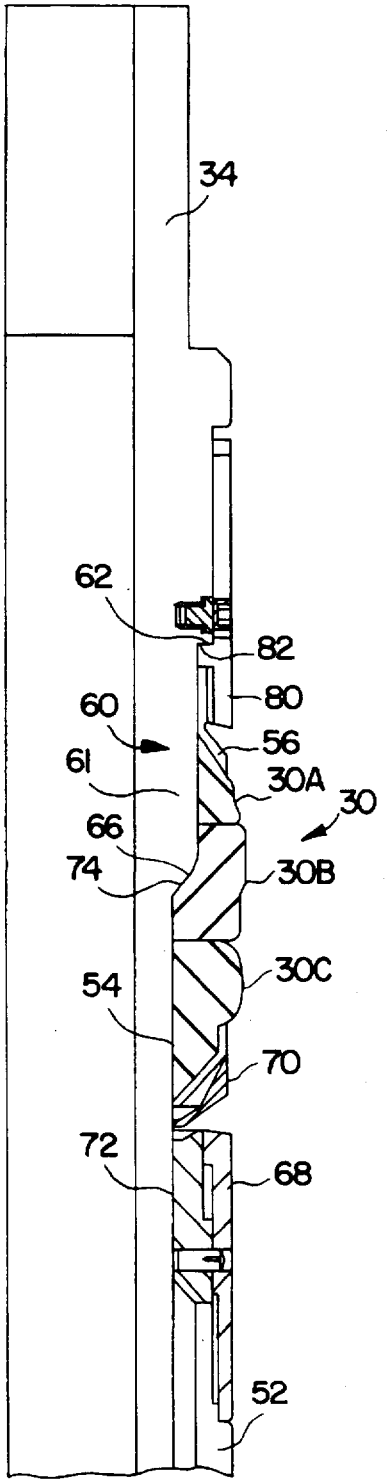
FIGS. 3A–3C, inclusive and taken together, form a longitudinal view in section of the retrievable well packer and seal assembly of the invention showing the seal assembly and the packer slips deployed as the packer is set in a well bore.

As shown in FIG. 2A, the upper outside seal element 30A has a substantially shorter longitudinal dimension than the central seal element 30B and the lower outside seal element 30C. The longitudinal dimension of the prop surface 64 is selected so that the upper outside seal element 30A is fully supported and the central seal element 30B is at least partially supported on the radially offset prop surface 64 in the set, expanded position, as shown in FIG. 3A. Even though the lower outside seal element 30C and the central seal element 30B may be subjected to longitudinal excursions as a result of pressure fluctuations, the sealing engagement of the upper outside seal element 30A is maintained at all times.

The lower and upper outside seal elements are reinforced with metal backup shoe 70 and 56, respectively. The metal backup shoes 70 and 56 provide a radial bridge between the mandrel 34 and the well casing 14 when the seal element assembly is expanded into engagement against the internal bore sidewall of the well casing, as shown in FIG. 3A. The purpose of the metal backup shoes is to bridge the gap between the mandrel and the casing and provide a support structure for the outside seal elements 30A and 30C, to prevent them from extruding into the annulus between the mandrel and the well casing.

The dimensions of the seal elements and the prop surface OD are selected to provide a minimum of 5 percent reduction in radially compressed thickness to a maximum of 30 percent reduction in radially compressed thickness as compared with the lower outside seal element 30C when compressed in the set position, for example as shown in FIG. 3A.

The backup shoes are preferably constructed in the form of annular metal discs, with the inside disc being made of brass and the outer metal disc being made of Type 1018 mild steel. Both metal discs are malleable and ductile, which is necessary for a tight conforming fit about the outer edge of the outside seal elements 30A and 30C.

The upper force transmitting apparatus 58 which applies the setting force to the seal element package includes a lower element retainer ring 72 mounted for longitudinal sliding movement along the seal element support surface 54 of the mandrel 34. An element retainer collar 68 is movably mounted on the external surface of the retainer ring 72 for longitudinal shifting movement from a retracted position (FIG. 2A) in which the seal elements are retracted, to an extended position (FIG. 3A) in which the seal elements are deployed.

Figure 4A:
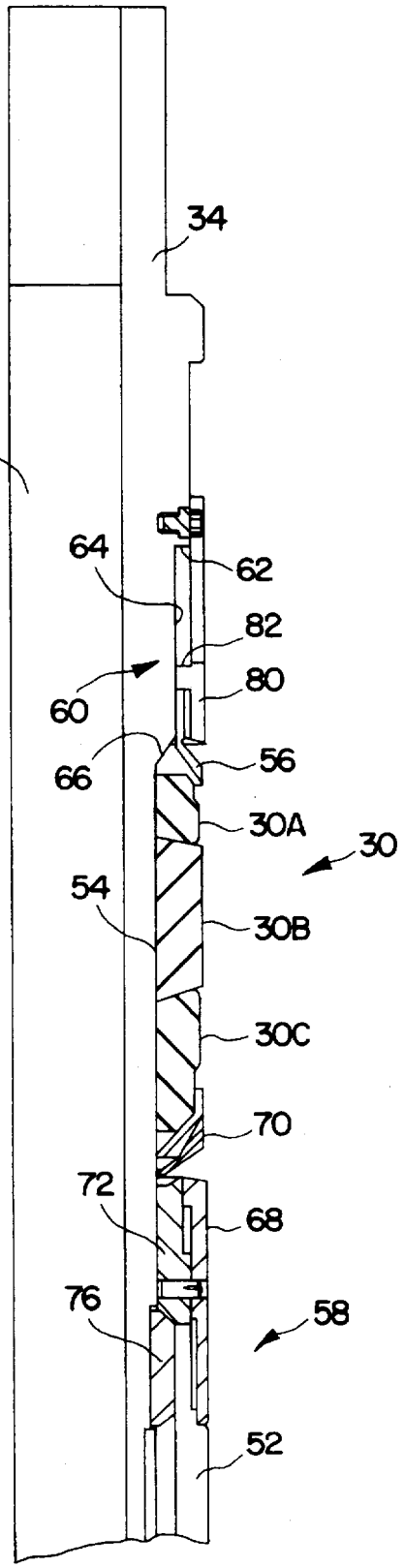
FIGS. 4A–4C, inclusive and taken together, form a longitudinal view in section of the retrievable well packer and seal assembly of the invention showing the seal assembly relaxed and the packer slips retracted as the packer is released and is ready for retrieval from a well bore.

The retainer ring 72 and element retainer collar 68 have mutually engageable shoulder portions 72A, 68A, respectively, for limiting extension of the element retainer collar along the external surface of the retainer ring. A split ring 76 is received within an annular slot 78 which intersects the external surface 54 of the mandrel 34. The split ring 76 limits retraction movement of the lower element retainer ring 72, thus indirectly limiting retraction movement of the element retainer collar 68, as shown in FIG. 4A.

Referring again to FIG. 2, the packer includes a locking assembly 148, which comprises the piston 42, mandrel 34, bottom connector sub 38, and cinch slip 102. The piston 42 concentrically and slidably fits over a portion of the bottom connector sub 38, as well as a portion of the mandrel 34. The piston is sealingly and concentrically fitted against the mandrel 34 as well as the bottom connector sub using seals S. The piston 42 further concentrically fits around a cinch slip 102, which in turn fits concentrically around the bottom connector sub 38. The outer surface 110 of the cinch slip is composed of a series of ridges, which are complementary to a series of ridges on the inner surface 112 of the piston, thereby interlocking the cinch slip and the piston. The piston 42 is further connected to the cinch slip 102 by pin 114.

The piston 42 and the bottom connector sub 38 define an annular gap 116, in which the cinch slip 102 is fitted. On the outer surface 118 of the bottom connector sub in the region from a radially offset shoulder 120 downward to a point proximate the lower end of the cinch slip 122 comprises a series of free radially spaced sharp tubular angular ridges. These ridges are complementary to ridges on the inner surface of the cinch slip. The complementary ridges on the bottom connector sub 38 and the cinch slip 102, together with the snug fit of the cinch slip 102 around the bottom connector sub 38, allow the cinch slip 102 to be forcibly moved upward with respect to the bottom connector sub 38, while not allowing the cinch slip 102 to move back downward with respect to the bottom connector sub 38. Upward travel of the cinch slip 102 with respect to the bottom connector sub 38 is limited by the radially offset shoulder 120. The cinch slip 102 is initially installed at the bottom of the annular gap 116, and sets on a wave spring 150.

A stop ring assembly 124 is positioned on the bottom connector sub 38 below the cinch slip 102, and connected to the cinch slip with a shear pin 126. The stop ring assembly 124 is set on a radially reduced offset surface 128 of the bottom connector sub, and is prevented from upward movement with respect to the bottom connector sub 38 by shoulder 130 which is complementary to shoulder 124A of the stop ring assembly.

Figure 3B:
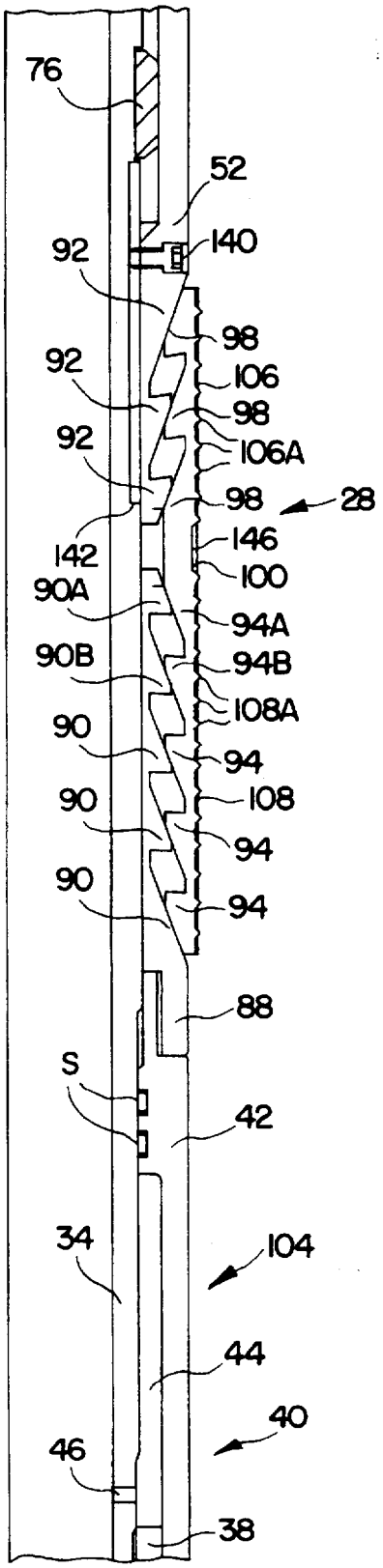
Figure 3C:
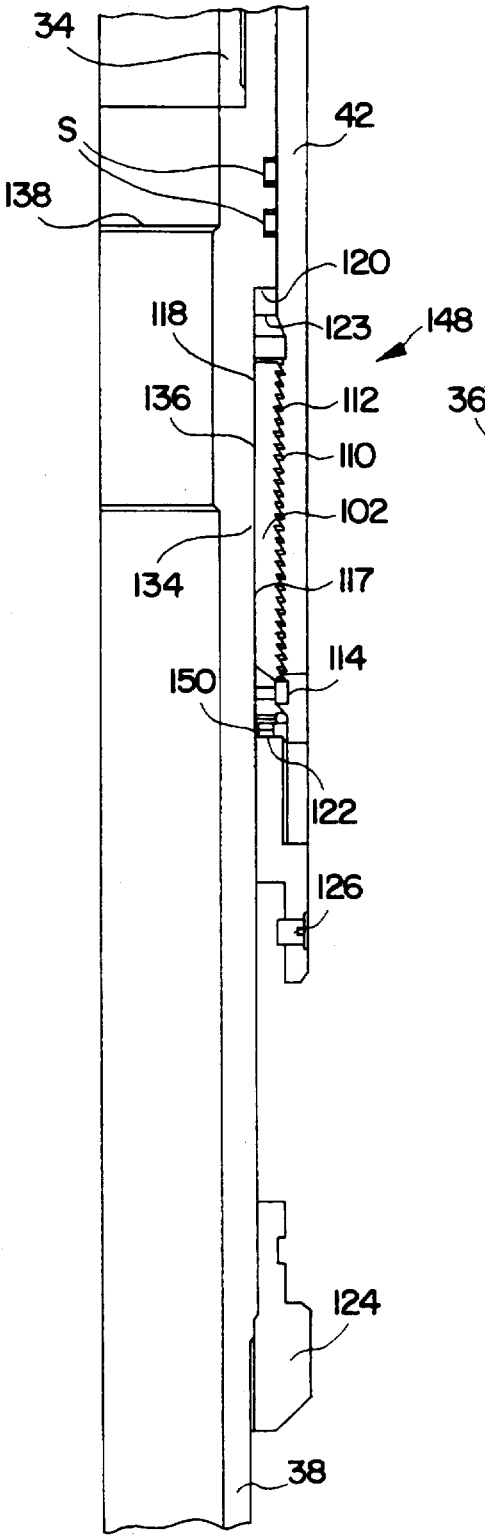

Referring now to FIGS. 3A–3C, once the packer has been run in and positioned in the desired location, fluid is forced into the annular chamber 44 under pressure, thereby causing the piston 42 to be forced upward. The piston in turn forces the entire anchor slip assembly 28 and upper force transmitting assembly 58 to move upward, forcing the retainer ring 72 and element retainer collar 68 upward. This in turn forces the lower backup shoe 70 upward against the seal element assembly 30. The seal element assembly moves upward, moving elements 30A and 30B up the ramp member 66 and onto the prop surface 64, moving the upper backup shoe 56 and the cover sleeve 80 upward ahead of it. When the shoulder 82 of the cover sleeve 80 contacts the radially offset shoulder 62 on the mandrel 34 and can move no further upward, the seal assembly 30 is compressed between the backup shoes and the seals expand radially, sealing the annulus around the packer.

Once the seal assembly 30 is fully deployed, the upper wedge 52 and lower wedge 88 begin to move towards each other. See FIG. 3B. As described above, the wedge cones 90, 92 are generally complementary to the slip cones 94, 98, wherein the wedge cones are spaced progressively further distances apart, as viewed from the centermost to outermost cones. As the wedges 52, 88 are forced towards each other, the end cones of the wedges 90A, 92A which mate with the centermost cones of the slip 94A, 98A make contact first. As the wedges continue towards each other, the slip 100 is forced out into engaging contact with the well casing 14. As the centermost pair of cones are the only ones in actual contact, the center of the slip is loaded first. As greater forces are exerted on the wedges, the wedges will deform slightly and the next cones of the wedges 90B, 92B will make contact with their matching slip cones 94B, 98B. As can be seen, as the wedges are loaded higher and higher, more wedge cones come into bearing contact with the slip. The standoff between the cones of the wedges is controlled very precisely such that slight elastic yielding takes place by deforming the wedge inwardly.

This design effectively allows initial setting of the packer with very little slip tooth contact area of the upper and lower gripping surface 108, 106. This permits the slip 100 to quickly get a good grip into the casing wall. Subsequent higher loading brings more and more slip teeth 132 on the gripping surface to bear and prevents overstressing the casing. Loading is continued until all the edges 106A, 108A of the gripping surface 106, 108 are firmly engaged with the wall of the casing.

This design may also be used with a plurality of individual slips in place of the barrel slip. Further, the progressively gapped cones may be on the slip, with the uniformly gapped cones on the wedges. Further, both sets of cones may have varying gaps, as long as the centermost cones of the slips are engaged first, followed by the next nearest cones, and so on, as the wedges are progressively loaded.

Referring now to FIG. 3C, as the piston 42 is being moved upward in response to the pressurizing of the annular chamber 44, the piston 42 pulls cinch slip 102 upward along the bottom connector sub 38, shearing shear pin 126. As the cinch slip 102 moves upward, the fine ridges 134 on the inner surface 117 of the cinch slip 102 are forced over the fine ridges 136 on the surface 118 of the bottom connector sub 38. The cinch slip 102 is thereby pulled upward with respect to the bottom connector sub 38 until the upper end 123 of the cinch slip 102 contacts the radially offset shoulder 120. Once moved upward with respect to the bottom connector sub, the cinch slip is prevented from moving downward again by the opposing ridges 134, 136 of the cinch slip and the bottom connector sub. Hence, once pressure is released from the annular chamber 44, the packer 10 will stay fully deployed, as the cinch slip 102 will not allow the piston 42, anchor slip assembly 28, upper force transmitting assembly 58 and seal assembly 30 from moving back downward with respect to the mandrel 34 and bottom connector sub 38. The cinch slip thereby helps ensure that no premature release of the packer occurs and that it remains locked in its deployed position. Indeed, there is no way to move the cinch slip back downward with respect to the bottom connector sub without literally dismantling the packer.

This embodiment as described above has been deployed and tested, and shown to be able to withstand pressure differentials of 15,000 psi and temperatures to 600° F. without moving longitudinally in the well.

Figure 4B:
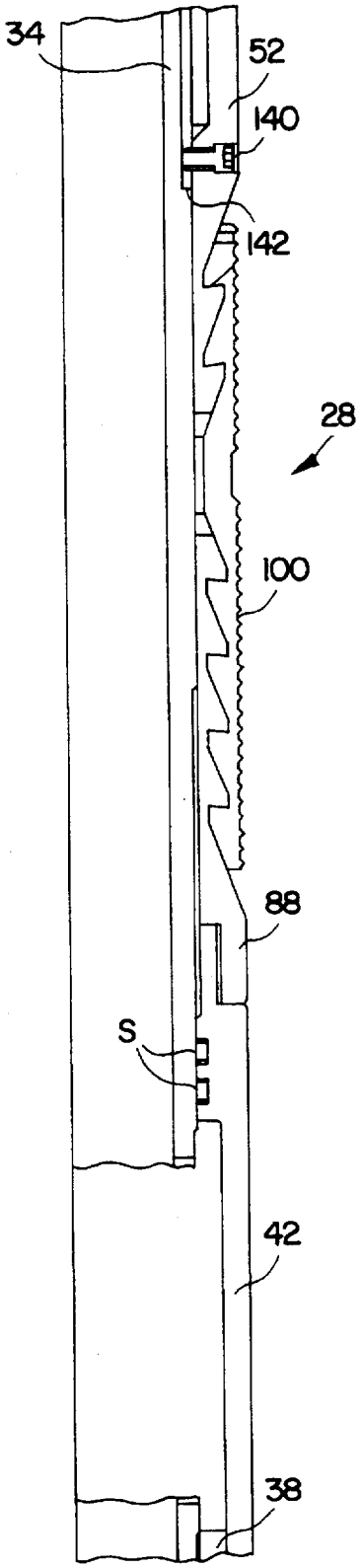
Figure 4C:
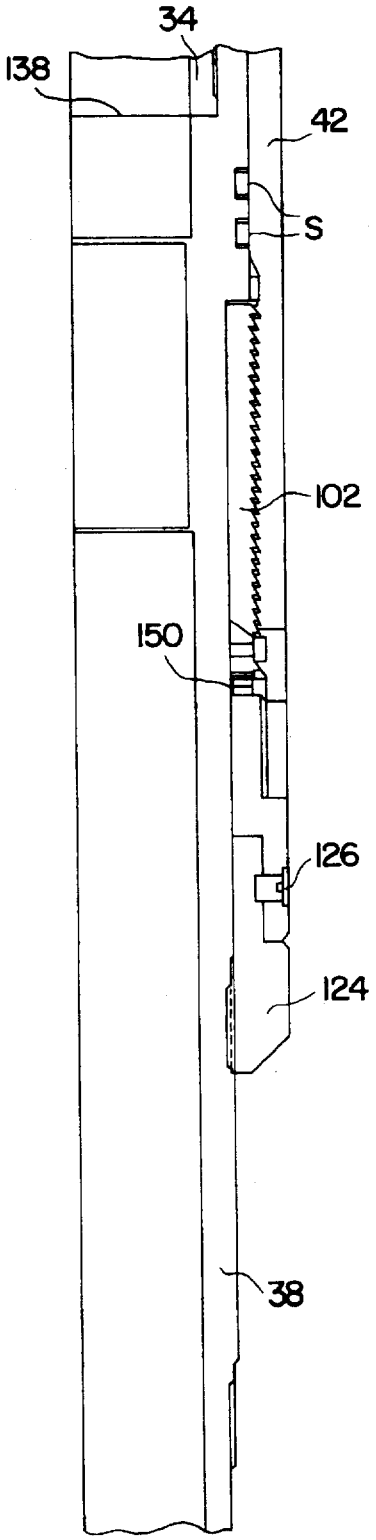
Figure 5:
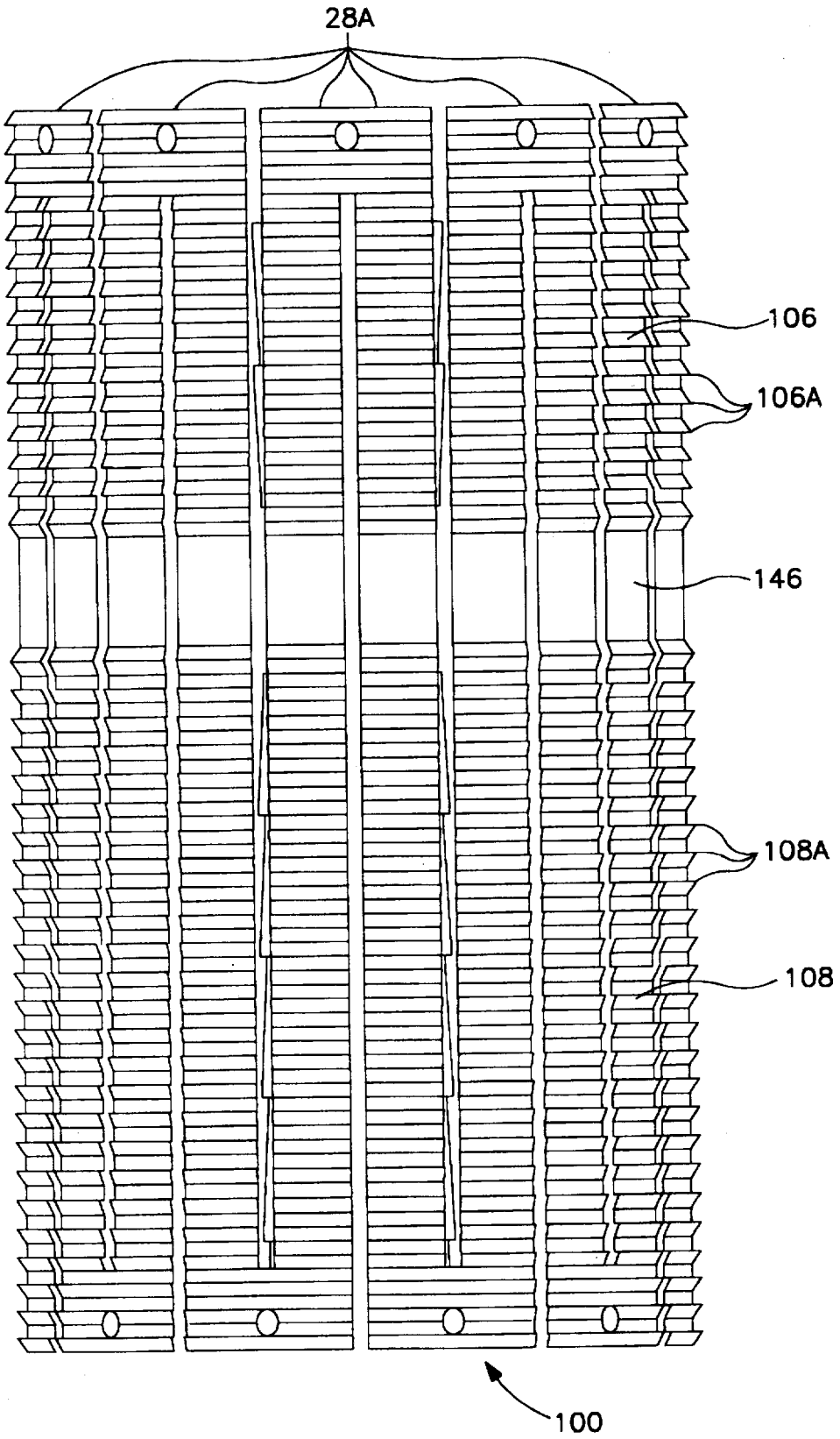
FIG. 5 is a plan view of a barrel slip of the invention removed from the packer.
Figure 6:
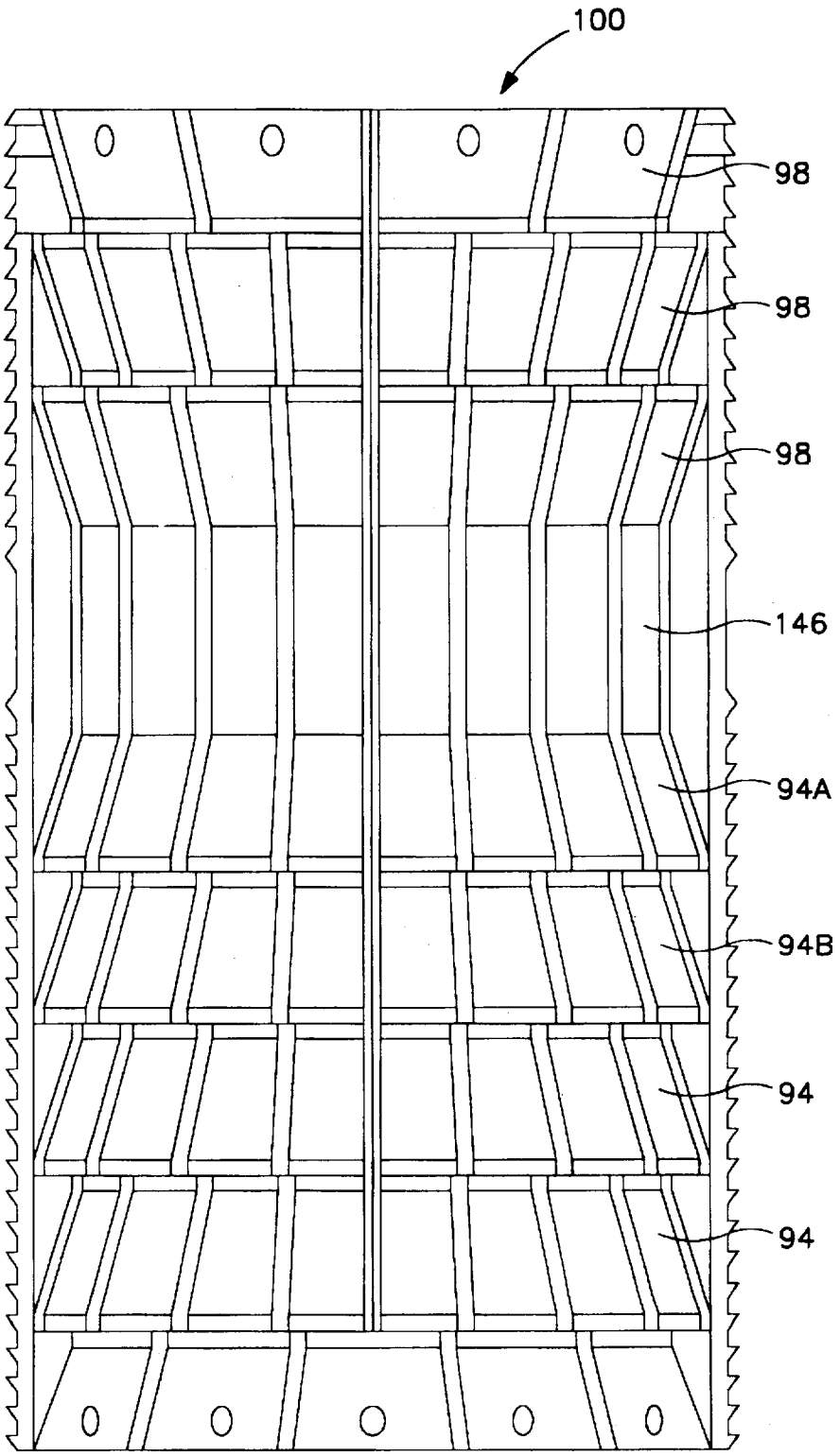
FIG. 6 is a plan interior view of a barrel slip of the invention removed from the packer.
Figure 7:
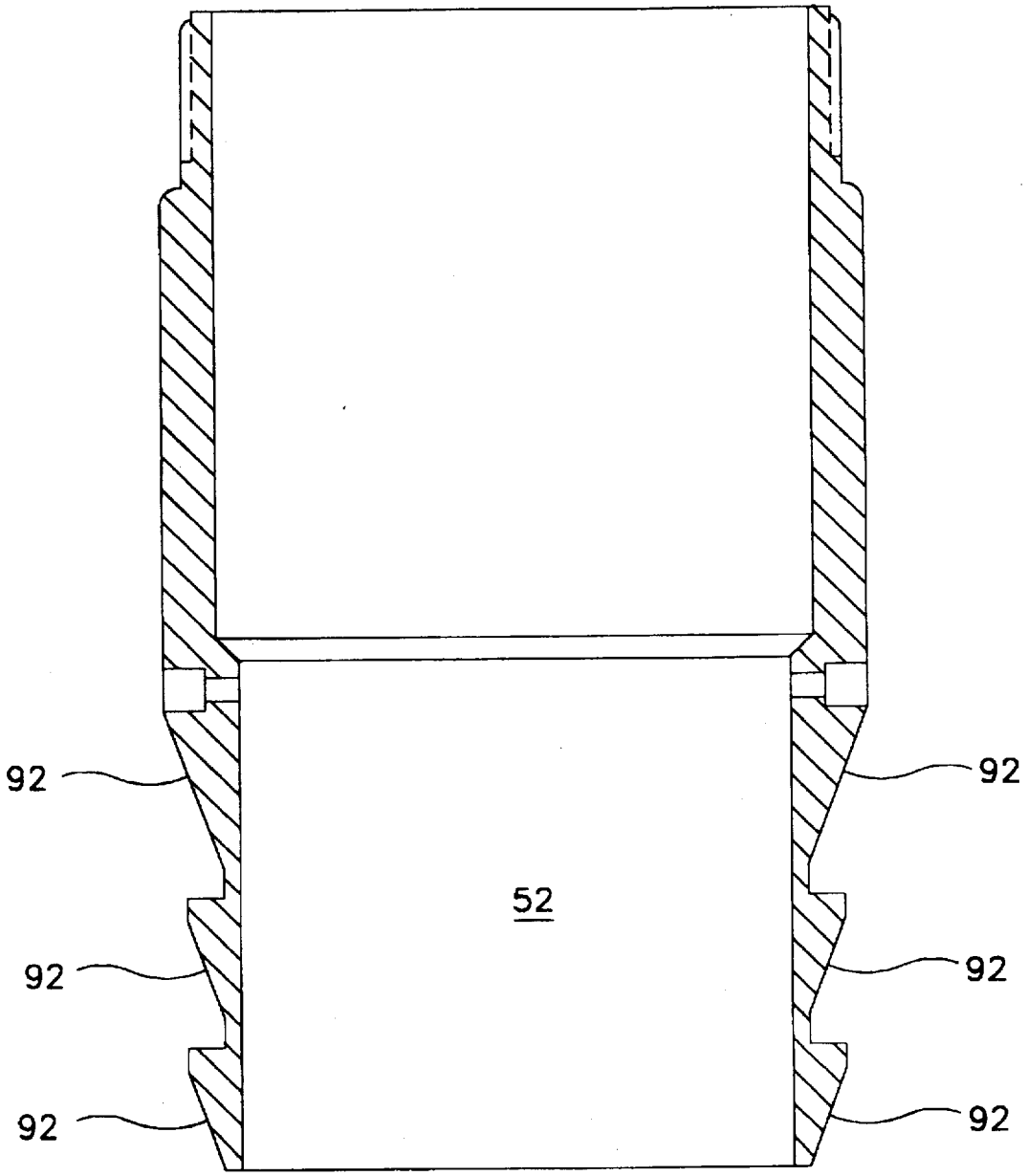
FIG. 7 is a longitudinal view in section of the top wedge removed from the mandrel; and, FIG. 8 is a longitudinal view in section of the bottom wedge removed from the mandrel.

Referring now to FIGS. 4A–4C, to release the packer, a cutting tool (not shown) is lowered into the mandrel 34 and set down on internal shoulder 138. The full circumference of the mandrel 34 is then cut at a level proximate the port 46. At this point, if there is any load on bottom connector sub 38, the bottom connector sub will be pulled downward. Alternatively, the tubing string 26 and the mandrel 34 can be pulled upward. Now that the mandrel 34 is cut, the mandrel 34 and the bottom connector sub 38 can move axially away from each other. As they move apart, the piston 42, which is securely connected to the cinch slip 102, which in turn is securely held in position on the bottom connector sub 38, is pulled downward with respect to the mandrel 34. As the piston moves downward, the upper and lower wedges 52, 88 are moved axially apart from each other, allowing the slip 100 to release. As the piston 42 is moved further downward with respect to the mandrel 34, the upper force transmitting assembly 58 is pulled downward, and the sealing assembly 30 thereby relaxes and move back down off of the prop surface 64 and onto the support surface 54.

The downward movement of the piston 42 with respect to the mandrel 34 is limited by set screw 140 of the upper wedge 52, which contacts a stop shoulder 142. At this point, as the slips and seal assembly are fully retracted, and as the piston is still connected to both the mandrel and the bottom connector sub, the entire packer can be pulled upward and out of the well together.

As the mandrel 34 is pulled upward, the radially reduced support surface 54 of the mandrel 34 provides an annular pocket into which the seal elements are retracted upon release and retrieval of the packer. That is, upon release and upward movement of the mandrel 34, the seal elements 30A, 30B are pushed off of the prop surface 64 and slide onto the lower mandrel seal support surface 54. Thus the seal elements are permitted to expand longitudinally through the annular pocket, and away from the drift clearance thereby permitting unobstructed retrieval.

Thus, the invention is able to meet all the objectives described above. The foregoing description and drawings of the invention are explanatory and illustrative thereof, and various changes in sizes, shapes, materials, and arrangement of parts, as well as certain details of the illustrated construction, may be made within the scope of the appended claims without departing from the true spirit of the invention. Accordingly, while the present invention has been described herein in detail to its preferred embodiment, it is to be understood that this disclosure is only illustrative and exemplary of the present invention and is made merely for the purposes of providing and enabling disclosure of the invention. The foregoing disclosure is neither intended nor to be construed to limit the present invention or otherwise to exclude any such embodiments, adaptations, variations, modifications, and equivalent arrangements, the present invention being limited only by the claims appended hereto and the equivalents thereof.

What we claim is:

1. A releasable packer for use in a subterranean well, said packer comprising:

a slip;

a sealing element operably connected to said slip; and, a locking assembly operably connected to said slip and said sealing element, to lock said packer in its deployed position, said locking assembly comprising;

an upper mandrel;

a bottom connector sub connected to said upper mandrel; and, a piston fitted concentrically and slidingly around said upper mandrel and said bottom connector sub, said piston being able to slide longitudinally along both said upper mandrel and said bottom connector sub, said piston being restricted from sliding completely off said upper mandrel or said bottom connector sub, said piston being lockable in an position in which said piston is covering a maximum amount of said upper mandrel and said packer is fully deployed; and, wherein said entire packer can be released for retrieval by cutting a portion of said locking assembly.

2. The packer of claim 1, wherein said locking assembly further comprising:

a cinch slip, said cinch slip being operably fitted between said piston and said bottom connector sub, said cinch slip being operably connected to said piston, said cinch slip being movable in only one longitudinal over said bottom connector sub, such that said piston can be moved to cover a maximum of said upper mandrel and such that said packer is deployed, said cinch slip not being movable in the opposite longitudinal direction and thereby locking said piston in place.

3. The packer of claim 1, wherein when said locking assembly is cut, the bulk of said upper mandrel and the bulk of said bottom connector sub can move longitudinally away from each other, allowing said piston to uncover a maximum of said upper mandrel without losing connection with said upper mandrel.

* * * * *